US006217433B1

(12) United States Patent
Herrman et al.

(10) Patent No.: US 6,217,433 B1
(45) Date of Patent: Apr. 17, 2001

(54) GRINDING DEVICE AND METHOD

(75) Inventors: James A. Herrman, Rockford, IL (US); Ronald A. Meyer, Beloit, WI (US); Douglas R. Stitt, South Beloit; Robert L. Woodard, Roscoe, both of IL (US)

(73) Assignee: Unova IP Corp., Woodland Hills, CA (US)

( * ) Notice: Subject to any disclaimer, the term of this patent is extended or adjusted under 35 U.S.C. 154(b) by 0 days.

(21) Appl. No.: 08/442,441

(22) Filed: May 16, 1995

(51) Int. Cl.[7] ..... B23F 21/03; B23F 21/23; B24B 33/00

(52) U.S. Cl. ..... 451/548; 451/262; 451/268

(58) Field of Search ..... 451/548, 285, 451/259, 287, 290, 262, 41, 64, 58, 63, 270, 271, 550, 268, 269

(56) References Cited

U.S. PATENT DOCUMENTS 2,442,129 * 5/1948 Hollstrom ..... 451/548
2,799,980 * 7/1957 Keeleric ..... 451/548
2,836,017 * 5/1958 Tygh ..... 451/548
2,882,655 * 4/1959 Osenberg ..... 451/548
4,663,890 * 5/1987 Brandt ..... 451/548
5,040,341 * 8/1991 Okinaga ..... 451/548
5,074,276 * 12/1991 Katayama ..... 451/41
5,191,738 * 3/1993 Nakazato et al. ..... 451/41
5,199,832 * 4/1993 Meskin et al. ..... 451/548

* cited by examiner

*Primary Examiner*—Derris H. Banks
(74) *Attorney, Agent, or Firm*—Morris I. Pollack

(57) ABSTRACT

Grinding wheels are fabricated with outwardly extending circular peripheral rims having a continuous rim surface to which separate abrasive pieces, preferably of a super abrasive such as CBN, are secured by suitable adhesive. The superabrasive pieces are preferably circular and of a diameter corresponding to the width of the rim and are secured to the rim surface so as to either be adjacent and touch one another or to be spaced one from the other around the circle of the rim surface so that a predetermined amount but not all of the rim surface is covered with abrasive pieces. That rim surface coverage optimize grinding efficiency while providing space for fluid flow for purposes of cooling and carrying away particles from the grinding process.

45 Claims, 4 Drawing Sheets

GRINDING DEVICE AND METHOD

BACKGROUND OF THE INVENTION-FIELD OF APPLICATION

This invention relates to grinding devices and methods of use of grinding devices; and more particularly to grinding devices constructed with a plurality of abrasive members and which employ such plurality of abrasive members in grinding processes.

BACKGROUND OF THE INVENTION-DESCRIPTION OF THE PRIOR ART

Some grinding devices are fabricated in the configuration of wheels or disks and employ the rim or cylindrical periphery of the wheel or disk in various grinding processes. Still other grinding devices, such as that shown in U.S. Pat. No. 2,089,040 employ the planar surface of the wheel or disk in various grinding processes, in fact, a pair of spaced and facing grinding devices are employed in the grinding processes of U.S. Pat. No. 2,089,040.

There are a considerable number of configurations for the grinding surfaces of grinding devices such as generally planar with a plurality of abrasive plugs embedded in the material of the wheel so that the exposed and utilized surfaces of the plugs are co-planar with the surrounding wheel surface as shown in U.S. Pat. No. 3,426,486; and generally curved and with spaced abrasive areas embedded in non-abrasive areas but so as to form a continuous curved surface as shown in U.S. Pat. No. 2,145,888. However, such continuous surface grinding devices are subject to the accumulation of "swarf" (the particles of grinding device material and material from the article being ground) between the grinding device and the article being ground, and the embedding of that "swarf" into the surface of the grinding device. This can reduce the efficiency of the grinding process; while movement of the "swarf" over the surface being ground can possibly scratch the surface of the articles being ground as well as otherwise hindering the grinding thereof.

Other grinding devices are constructed with: a plurality of bulges as shown in U.S. Pat. No. 2,262,583; a plurality of openings as shown in U.S. Pat. No. 3,041,799; and/or a plurality of spaced grinding rings separated by annular channels as shown in U.S. Pat. No. 2,201,410. However, even such grinding wheel constructions may be inadequate to efficiently remove coolant and other fluids and "swarf" from between the grinding device surface and surface being ground or to remove same quick enough.

Still other grinding devices utilize plural concentric grinding rings, each of different composition but concentrically mounted and in spaced relationship, with the respective grinding surfaces co-planar as shown in U.S. Pat. No. 2,309,016; while other grinding devices position plural spaced rings, each with different composition grinding surfaces, in planes that are angularly disposed one with respect to the other as shown in U.S. Pat. No. 2,451,295; and still other grinding devices utilize plural spaced grinding rings of different composition that have their grinding surfaces in different planes as shown in U.S. Pat. No. 2,673,425. However, here again, the spacings, if any, between the respective grinding rigs of these grinding devices may still prove insufficient to remove grinding fluids and "swarf" from the surface to be ground in an acceptable manner.

U.S. Pat. No. 4,456,500 shows and describes a grinding device in the form of a polisher wherein a plurality of teeth are formed from the base material of the polisher by a photoresist method. The resulting teeth, however, must be formed from the material of the grinding device base thus resulting in a possibly unwanted expense of forming the entire device of abrasive material which could be significant if it is desired to use a relatively expensive superabrasive as the abrasive material. U.S. Pat. No. 4,539,017 on the other hand forms the cylindrical peripheral surface of a grinding wheel with spaced islands of abrasive (in various configurations) molded by a centrifugal process to a foamed elastomer base to provide an elastic grinding element. The resulting grinding wheel because of the elastic base would appear to have limited application. In addition, centrifugal process for manufacture of these grinding devices would not be capable of producing a grinding device with similar abrasive islands disposed on a planar surface of a grinding device disk or wheel.

Arcuate and spaced grinding segments have been secured to a grinding device disk so as to provide an annular and planar grinding surfaces therefore as shown in U.S. Pat. No. 2,867,063. However, the grinding device disk construction for receiving those arcuate grinding segments requires spaced channels within which the arcuate grinding segments are secured by being bolted in place. The channel construction would appear to provide spaces within which unwanted "swarf" and other materials might collect thus possibly detrimentally affecting wheel operation and grinding efficiency. In addition, the wheel disk that carries the arcuate segments appears to be relatively complex and costly.

U.S. Pat. No. 2,629,975 shows circular blocks of abrading material embedded in arcuate segments that alternate about the same axis to form either a rough grinding device or a finish grinding device. The respective rough and finish grinding devices are utilized alternatively and not together. The patent provides no further detail concerning the size, spacing or thickness above the segment carrier surface for the abrading material or whether any part of such abrading material, in fact, is disposed above the surface of the arcuate members within which the cylindrical blocks of abrading material are embedded. The preparation of the carriers to receive the embedded abrasive blocks requires relatively costly expense and time as well as the time and expense to imbed the blocks in their respective carriers.

SUMMARY OF THE INVENTION

It is therefore an object of this invention to provide new and novel grinding devices.

It is another object of this invention to provide new and novel combinations of grinding wheels or disks and grinding abrasives.

It is yet another object of this invention to provide new and novel processes for grinding articles of manufacture.

It is still another object of this invention to provide new and novel processes for more efficiently grinding articles such as brake rotors, power steering pump rings and rotors, valve plates and the like.

It is yet still another object of this invention to provide new and novel grinding wheels or disks which optimize the amount of abrasive to be utilized for grinding while at the same time also optimizing the arrangement of such abrasives to facilitate the flow of coolant and other fluids and the removal of "swarf" from the grinding area.

It is a further object of this invention to provide new and novel grinding wheels or disks which carry multiple abrasive pieces each of which is of optimum thickness and each of which provides an optimum abrasive surface for grinding.

Other objects and features of the inventions in their details of construction and arrangement of parts will be seen from the above and from the following description of the preferred embodiments when considered with the drawing and from the appended claims.

DESCRIPTION OF THE PREFERRED EMBODIMENTS

Figure 1:
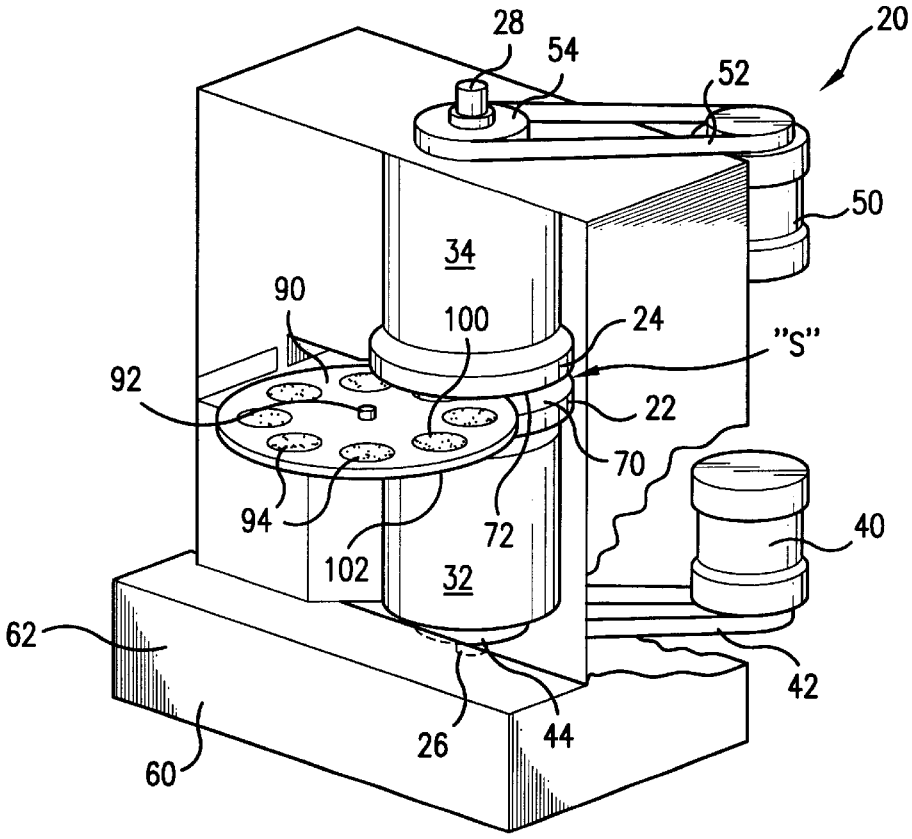
FIG. 1 is a schematic, in perspective, of a grinding machine utilizing grinding wheels, incorporating the instant invention, for grinding articles of manufacture according to processes also incorporating the instant invention.

With reference to FIG. 1 there is generally shown at 20 a schematic of a grinding machine incorporating a pair of grinding wheels 22, 24 carried by grinding wheel spindles 26, 28 which are, in turn, rotatively carried by workheads 32, 34 respectively. Workheads 32, 34 and spindles 22, 24 are shown disposed in a vertical spindle configuration (i.e. with their respective spindle axis of rotation in vertical co-linear alignment) but could also be disposed in a horizontal configuration (i.e. with their respective spindle axis of rotation in horizontal co-linear alignment). A first motor 40 serves to provide a rotative drive to spindle 26 and grinding wheel 22 through a drive belt 42 and pulley 44 arrangement; while a second motor 50 serves to provide a rotative drive to spindle 28 and grinding wheel 24 through a drive belt 52 and pulley 54 arrangement. Suitable and conventional power is provided for motors 40, 50 through suitable and conventional controls 60 carried by and/or within machine frame and base 62.

Spindles 26, 28 and workheads 32, 34 are carried by machine frame and base 62 for movement towards and away from each other through controls 60 and otherwise in a conventional manner, and so as to provide for a spacing "S" between a work face 70 of grinding wheel or disk 22 and a work face 72 of grinding wheel or disk 24.

An article carrier 90 is conventionally disposed for rotation about an axis 92 to move articles 94 to be ground through space "S" and between work face 70 of grinding wheel 22 and work face 72 of grinding wheel 24 all in substantially conventional manner. The spacing "S" of faces 70, 72 is set to permit entry therein to of article carrier 90 with articles 94 carried thereby and to facilitate grinding faces 100, 102 of articles 94 by movement of faces 70, 72 of grinding wheels 22, 24 towards and into contact with faces 100, 102 of articles 94; all in substantially conventional manner and under control of controls 60. After each article 94 has had its faces 100, 102 ground the article exits space "S" from between grinding faces 70, 72, is removed from article carrier 90 and is replaced by another article 94 with unground faces 100, 102 also in conventional manner.

The respective grinding faces 70, 72 of grinding wheels 22, 24 and the use of those faces and grinding wheels to grind articles comprise the instant invention.

Grinding wheels 22 and 24 are identical in construction and use and accordingly only grinding wheel 22 will be described in detail and with respect to FIGS. 2 and 3.

A grinding wheel base 120 (FIGS. 2 and 3) is provided for grinding wheels 22, 24. Each base 120 is circular and disk-like and includes a peripheral rim 122 extending up from a face 124 of base 120. A plurality of openings 130 (FIGS. 2 and 3) extend through base 120 to facilitate securing grinding wheel base 120 to grinding wheel spindle (22, 24) with a rear face 132 of base 120 disposed adjacent or proximate a corresponding surface or face (not shown) of the spindle. Additional openings 140 (FIG. 2) also extend through base 120 to facilitate securing base 120 to its spindle.

An annular surface 140 (FIG. 2) of rim 122 extends between concentric walls thereof and is configured and disposed to receive a plurality of abrasive pieces 150 which are secured in place by a suitable adhesive such as an epoxy or the like. While FIG. 2 only shows a few abrasive pieces 150 adhesively secured to surface 140 of rim 122 it should be understood that such abrasive pieces 150 are adhered to surface 140 in an array about the entire rim 122 as shown in FIG. 4; and that while FIG. 4 shows such abrasive pieces 150 slightly spaced one from the other that such abrasive pieces 150 may, in fact, be disposed so as to touch as shown in FIG. 2 or so as to be slightly spaced as shown in FIG. 4.

Figure 5:
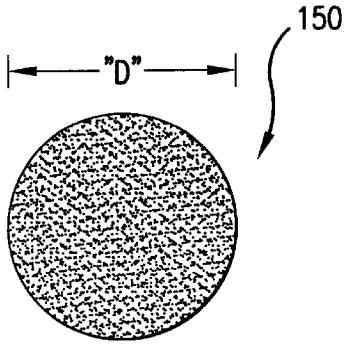
FIG. 5 is a plan view of one of the abrasive pieces utilized for the grinding wheel of FIGS. 2–4, enlarged to better show details thereof.
Figure 6:
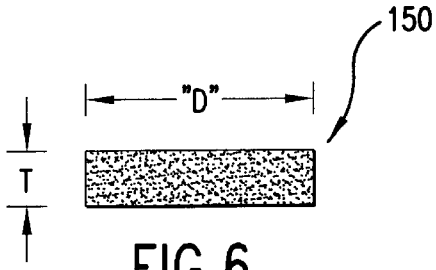
FIG. 6 is an end view of the abrasive piece of FIG. 5.

Each abrasive piece 150 (FIGS. 2–6) is of circular disk-like or wafer configuration and is preferably fabricated from vitrified material with CBN cubic boron nitride or diamond to provide super abrasive abrasive pieces. Abrasive pieces 150 also be fabricated from formulations utilizing resin bond or metal bond and incorporating CBN or diamond. Other combinations of the aforementioned materials may also be utilized for abrasive pieces 150. The diameter "D" (FIGS. 5 and 6) of each abrasive piece 150 preferably corresponds to the thickness "t" (FIG. 3) or width of rim 122. An abrasive piece one inch (1") in diameter has been found to function well but abrasive pieces in a range between one-half inch "½" to one and one-half inches (1½") will also serve the purpose. Each abrasive piece is preferably fabricated to a thickness "T" (FIG. 6) of one-eighth of an inch (⅛") but abrasive piece thickness between one-sixteenth of an inch (1/16") and one-half an inch (½") would also function for the intended purpose.

Figure 7:
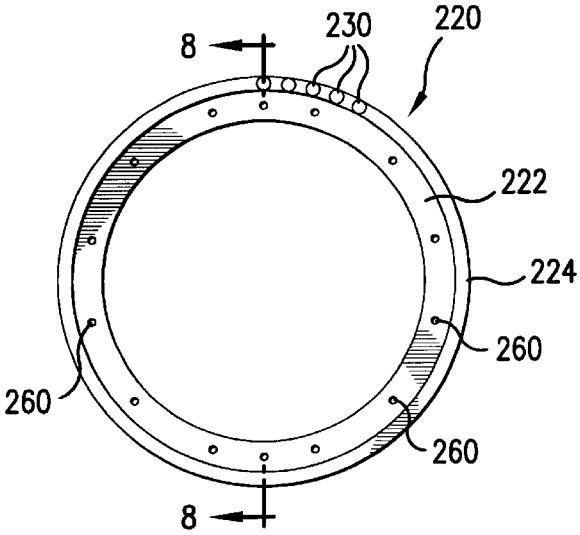
FIG. 7 is a plan view of an alternative grinding wheel, incorporating the instant invention, but only showing some of the abrasive pieces disposed thereon to better show details thereof.
Figure 8:
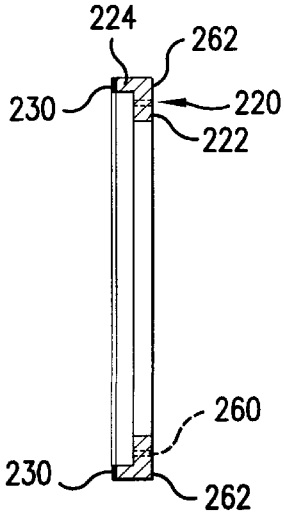
FIG. 8 is a section view taken on line 8—8 of FIG. 7 with parts cut away to better show details thereof.

In FIGS. 7 and 8 an alternative embodiment of grinding disk 220 is shown. Disk 220 is formed with an annular ring base 222 that includes an annular rim 224 about which abrasive pieces 230 are affixed preferably by a suitable adhesive such as that utilized for securing abrasive pieces 150 of FIGS. 2–6 to rim 122 (FIGS. 2–4) of disk 120. Abrasive pieces or wafers 230 are preferably fabricated from the same materials as disks 150 and in similar size ranges of diameter and thickness; with the thickness of rim 224 substantially corresponding to the diameter of the abrasive pieces 230 that are to be affixed thereto.

Figure 2:
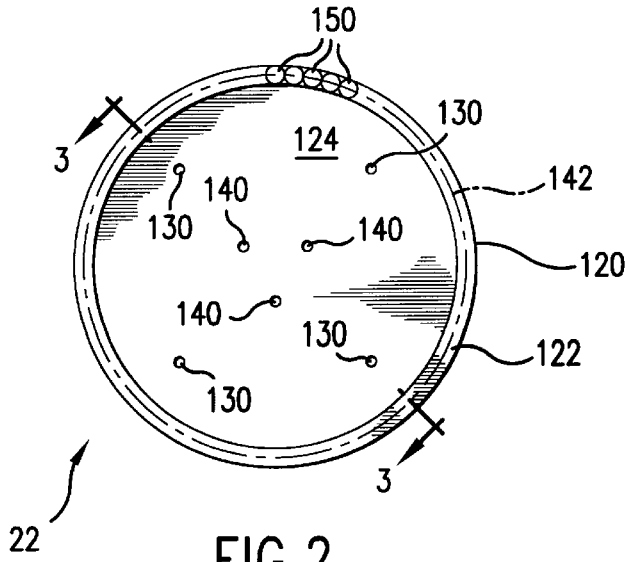
FIG. 2 is a plan view of a grinding wheel or disk, incorporating the instant invention, but only showing some of the abrasive pieces disposed thereon to better show details thereof.
Figure 4:
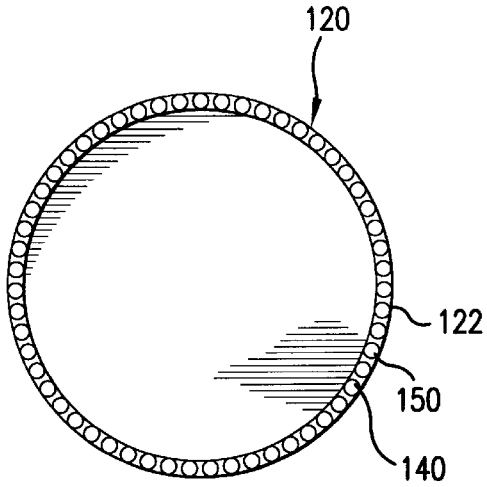
FIG. 4 is a schematic plan of the rim of the grinding wheel or disk of FIGS. 2 and 3 showing a layout of abrasive pieces thereon.

Abrasive pieces 230 are applied to rim 224 of disk 220 about the entire rim as shown for pieces 150 and rim 122 of disk 120 and may be so applied in a spaced relationship as shown in FIG. 7 or closely adjacent each other as shown for pieces 150 in FIGS. 2 and 4.

A plurality of internally threaded openings 260 are formed in a rear face 262 (FIG. 8) of grinding disk 220 to facilitate securing a mounting plate (not shown) and grinding disk 220 together and to facilitate securing the so assembled grinding disk 220 and mounting plate to a grinding spindle such as spindles 22 or 24 (FIG. 1).

Figure 3:
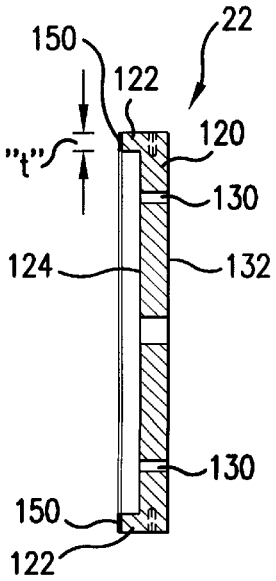
FIG. 3 is a section view taken on line 3—3 of FIG. 2 with parts cut away to better show details thereof.
Figure 9:
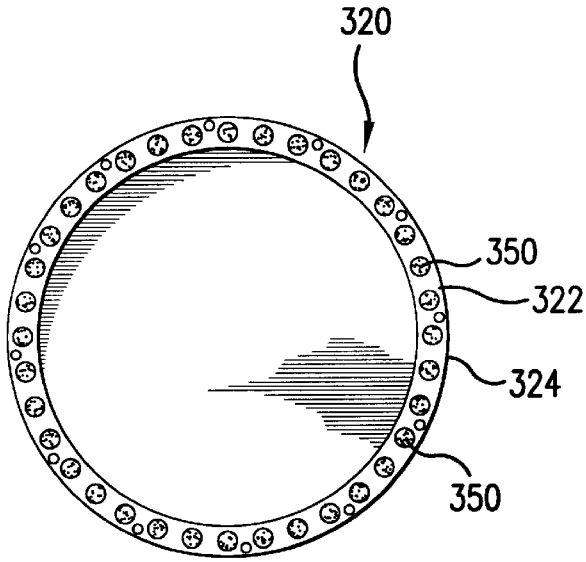
FIG. 9 is a schematic plan of the rim of the grinding wheel or disk of FIGS. 7 and 8 showing a layout of abrasive pieces thereon.
Figure 10:
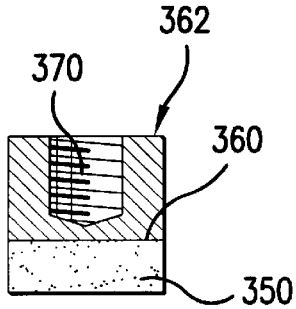
FIG. 10 is a vertical elevation section through an alternate abrasive piece and carrier, according to the instant invention, enlarged to better show details thereof.
Figure 11:
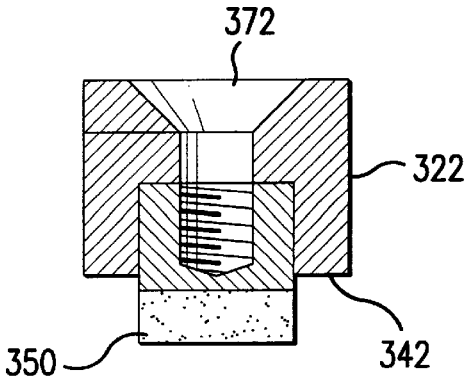
FIG. 11 is a vertical elevation through the abrasive piece and carrier of FIG. 10 showing same disposed on a section of grinding wheel or disk according to the instant invention.

Another alternative grinding wheel construction is shown in FIGS. 9–11 wherein a grinding wheel base 320 which may be similar in construction to either base 120 of FIGS. 2 and 3 or base 220 of FIGS. 7 and 8 is provided with an annular rim 322 (FIGS. 9 and 11) having an annular surface 324. A plurality of abrasive pieces 350 are disposed about surface 324 of rim 322. Each such abrasive piece 350 is fabricated of similar materials and to similar dimensions as abrasive pieces 150 of FIGS. 2–6 or abrasive pieces 230 of FIGS. 7 and 8.

Each abrasive piece 350 is adhered to a surface 360 of a mounting piece 362 by a suitable adhesive such as that utilized to secure abrasive pieces 150 and 230 to their respective rims 122 and 224. An internally threaded opening 370 extends into mounting pieces 326 to receive an externally threaded member (not shown), such as a bolt or the like, that extends through an opening 372, formed through rim 322 of base 320, to secure a mounting piece 363 and its abrasive piece or wafer 350 to grinding disk 320. Mounting pieces 362 and abrasive pieces 350 may be so secured and disposed about rim 322 as shown in FIG. 9 or they may be otherwise spaced closer or further apart as will be hereinafter explained in greater detail.

Articles 94 to be ground may be items and parts such as brake rotors, power steering pump rings and rotors, valve plates or the like. Such articles 94 are fed between grinding wheels 22, 24 and the grinding wheels are rotated and advanced towards each other by specified amounts to grind off the correct amount of material from articles 94.

The grinding process creates granular material both from the abrasive used for grinding and the article being ground. Preferably that granular material or "swarf" is carried away by fluids utilized for that purpose and which also serve to cool the articles being ground and the grinding wheels.

To effectively cool and to effectively carry away the swarf the fluid must circulate over and about the abrasive surfaces and over and about the articles to be ground. Thus, if the entire surface of the grinding wheel rims were covered with abrasive then it would greatly restrict the flow of coolant and articles would not be properly ground. In fact, heat generated during the grinding process could effectively destroy and render useless the articles being ground. Alternatively, too great a spacing between areas of abrasive of the rims of the respective grinding wheels or disks might result in inefficient grinding or improper grinding of the articles.

Figure 12:
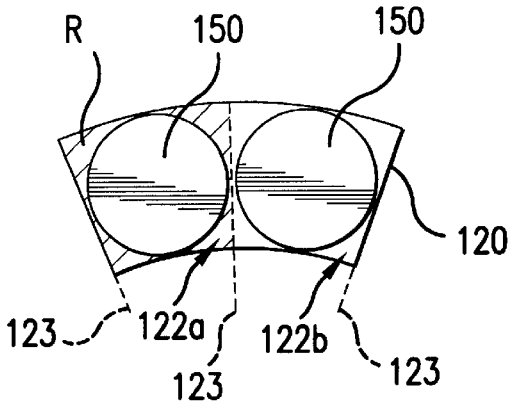
FIG. 12 is a plan view of a section of the grinding wheel or disk of FIGS. 2–4 enlarged to better show the disposition of the abrasive pieces thereon and the relative disposition of the abrasive pieces with respect to each other.
Figure 13:
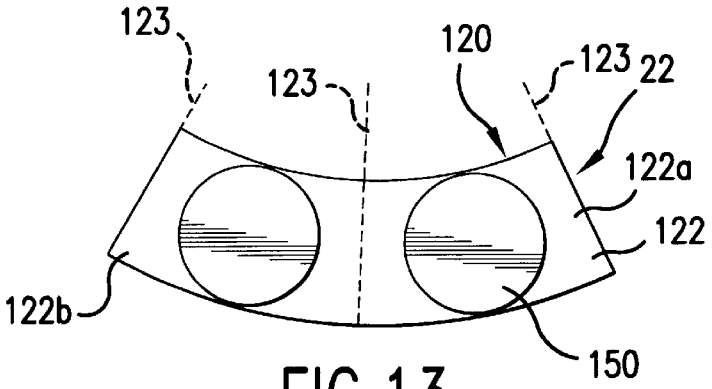
FIG. 13 is a plan view of a section of the grinding wheel or disk of FIGS. 7–9 enlarged to better show the disposition of the abrasive pieces thereon and the relative disposition of the abrasive pieces with respect to each other.
Figure 14:
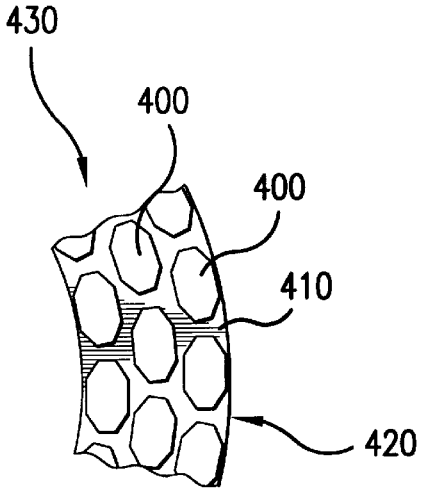
FIG. 14 is a schematic showing an alternative abrasive piece configuration and an alternative arrangement plan for said abrasive pieces on a grinding wheel disk all according to the instant invention.

FIGS. 12 and 13 both show a pair of abrasive pieces 150 disposed one proximate the other on a portion of the surface 122 of rim 120 of grinding wheel 22. Surface 122 has been divided into sectors 122*a*, 122*b* by dotted lines 123 and as such the entire surface 122 of rim 120 could be similarly divided into similar sectors. Each sector 122*a*, 122*b*, . . . , 122*n* has a given area "A" for its portion of surface 122 of rim 120; and each abrasive piece or wafer 150 covers a predetermined portion "W" of each sector area "A". The remaining sector surface area "R" (shown cross-hatched in FIG. 12) that is not covered by an abrasive piece or wafer 150 provides a space over and through which fluids can flow to cool the grinding disk, and articles to be ground and to carry away "swarf".

In FIG. 12 abrasive pieces 150 are spaced one adjacent the other and the covered area "W" equals a maximum percent of area A; while in FIG. 13 abrasive pieces 150 are spaced one from the other and covered area "W" is a lesser percent of area A then that for the configuration of FIG. 12. A percentage of covered are "W" ranging between 60 to 80 percent of sector area A is preferable to maximize grinding efficiency utilizing grinding disks according to the instant invention; while a percentage of covered area "W" ranging between 10% and 90% of the sector area could provide acceptable grinding.

FIG. 13 shows yet another embodiment of configuration of abrasive pieces 400 and arrangement of pieces 400 on a surface 410 of a rim 420 of a grinding disk 430. Abrasive pieces 400 are shown with an octagonal, non-circular, configuration. Pieces 400 are otherwise fabricated from the same material as pieces 150 and to similar dimensions. Other peripheral configurations may be utilized. In addition, pieces 400 are applied to surface 410 of rim 420 in the same manner that abrasive pieces 150 are applied to surface 122 of rim 120. Rim 420 is however wider than rim 120 and abrasive pieces 400 are applied to surface 410 in spaced relationship so as to provide for at least acceptable grinding as hereinabove described and preferably so as to maximize grinding efficiency as hereinabove described.

From the above description it will thus be seen that there has been provided new and novel grinding wheels and grinding processes.

It is understood that although I have shown the preferred embodiments of my invention that various modifications may be made in details thereof without departing from the spirit as comprehended by the following claims.

What is claimed is:

1. A grinding wheel; comprising:

(a) disk-like base means for mounting the grinding wheel and having a substantially planar base surface;

(b) rim means extending from said disk-like base means and having a rim which lies in a plane parallel to and spaced from said base surface;

(c) said rim surface having a rim surface area;

(d) abrasive means comprising a plurality of abrasive pieces each having an abrasive piece surface area;

(e) each said abrasive piece being secured to said rim surface to form an array of abrasive pieces so that said abrasive pieces are disposed upon said rim surface with open spacing therebetween all so as said array of abrasive pieces covers a selected area of said rim surface; and (f) said selected area comprising no more than eighty percent of said rim surface area and no less than sixty percent of said rim surface area.

2. The grinding wheel of claim 1, wherein said disk-like base means has first face surface and a second face surface that are disposed in parallel planes and a peripheral edge extending between said first surface and said second surface and wherein said rim means extends from either said first surface or said second surface at a predetermined angle with respect thereto.

3. The grinding wheel of claim 2, wherein said predetermined angle is substantially ninety degrees to said surface from which said rim means extends.

4. The grinding wheel of claim 3, wherein said rim means surface is continuous and endless.

5. The grinding wheel of claim 4, wherein said peripheral edge is circular.

6. The grinding wheel of claim 5, wherein said rim means is circular and concentric with said peripheral edge.

7. The grinding wheel of claim 6, wherein said rim means extends from said surface proximate said peripheral edge.

8. The grinding wheel of claim 7, wherein said rim means includes parallel concentric circular walls that are spanned by said rim surface and wherein an outermost one of said rim means walls is concentric with and of the same diameter as said peripheral edge.

9. The grinding wheel of claim 8, wherein said array of abrasive pieces are uniformly spaced about said rim surface.

10. The grinding wheel of claim 9, wherein said array of abrasive pieces are uniformly spaced about said rim surface so as to cover no less than sixty percent of said rim surface or no more than eighty percent of said rim surface.

11. The grinding wheel of claim 1, wherein said array of abrasive pieces are uniformly spaced about said rim surface.

12. The grinding wheel of claim 1, wherein said array of abrasive pieces are uniformly spaced about said rim surface so as to cover no less than sixty percent of said rim surface or no more than eighty percent of said rim surface.

13. The grinding wheel of claim 1, wherein each said abrasive piece is disk-like with a circular peripheral edge.

14. The grinding wheel of claim 13, wherein each said abrasive piece is one-sixteenth of an inch in thickness and one inch in diameter.

15. The grinding wheel of claim 13, wherein each said abrasive piece is between one-sixteenth and one-half inch in thickness and between one-half to one and one-half inches in diameter.

16. The grinding wheel of claim 15, wherein each abrasive piece is fabricated as a superabrasive.

17. The grinding wheel of claim 16, wherein said superabrasive is cubic boron nitride.

18. A grinding process for a grinding machine having a pair of spaced grinding spindles each of which can carry a grinding wheel so that articles to be ground may be moved between and engaged by an abrasive means carried each such grinding spindle and have respective sides of each such article ground thereby; comprising:

(a) forming each grinding wheel with a rim having a rim surface disposed in a plane substantially parallel to the plane of the surface on the article to be ground;

(b) securing to each said rim surface of each said grinding wheel a plurality of abrasive pieces in an array such that a predetermined portion of the area of each such rim surface is covered by an abrasive piece;

(c) securing each said grinding wheel to grinding wheel spindle;

(d) advancing the grinding wheel spindles towards each other and into engagement with opposed surface of the article to be ground and rotating said grinding wheel spindles and grinding wheels and grinding the opposed surfaces of the article to be ground by a predetermined amount; and (e) passing a fluid about and over said abrasive pieces and about and over the surfaces being ground.

19. The grinding process of claim 18, including providing article feed and rotating said article feed means to feed articles to be ground between said grinding wheel abrasive pieces.

20. The grinding process of claim 19, including forming each said grinding wheel with a disk-like base means having a first face surface and a second face surface disposed in parallel planes and with a peripheral edge that extends between said first surface and said second surface and forming said rim to extend from either said first surface of said second surface and at a predetermined angle thereto.

21. The grinding process of claim 20 including forming said rim surface to be continuous and endless.

22. The grinding process of claim 21 including forming said peripheral edge to be circular.

23. The grinding process of claim 21 including disposing said array of abrasive pieces about said rim surface so as to cover no more than eighty percent thereof.

24. The grinding process of claim 23 including disposing said array of abrasive pieces to be uniformly spaced about said rim surface.

25. The grinding process of claim 24 including disposing said array of abrasive pieces uniformly spaced about said rim surface and so as to cover no less than sixty percent of said rim surface or no more than eighty percent of said rim surface.

26. The grinding process of claim 25 including forming each said abrasive piece disk-like and with a circular peripheral edge.

27. The grinding process of claim 26 including forming each said abrasive piece to be one-sixteenth of an inch in thickness and one inch in diameter.

28. The grinding process of claim 27 including forming each said abrasive piece to be between one-sixteenth and one-half inch in thickness and between one-half to one and one-half inches in diameter.

29. The grinding process of claim 28 including forming each abrasive piece as a superabrasive.

30. The grinding process of claim 29 including forming said superabrasive from cubic boron nitride.

31. A grinding wheel; comprising:

(a) a disk-like base for mounting the grinding wheel and having a substantially planar base surface;

(b) a rim extending from said disk-like base and having a rim surface which lies in a plane parallel to and spaced from said base surface;

(c) said rim surface having a rim surface area;

(d) a plurality of abrasive pieces carried by said rim surface;

(e) each said abrasive piece having an abrasive piece surface area;

(f) said abrasive pieces each being secured to said rim surface to form an array of abrasive pieces carried by said rim surface such that said abrasive pieces are disposed upon said rim surface with a predetermined open spacing therebetween all so as said array of abrasive pieces covers not more than eighty percent of said rim surface area and not less than sixty percent of said rim surface area.

32. The grinding wheel of claim 31, wherein said disk-like base has a first face surface and a second face surface that is disposed in parallel planes and a peripheral edge extending between said first surface and said second surface and wherein said rim extends from either said first surface or said second surface at a predetermined angle with respect thereto.

33. The grinding wheel of claim 32, wherein said predetermined angle is substantially ninety degrees to said surface from which said rim means extends.

34. The grinding wheel of claim 33 wherein said rim surface is continuous and endless.

35. The grinding wheel of claim 34, wherein said peripheral edge is circular.

36. The grinding wheel of claim 35 wherein said rim is circular and concentric with said peripheral edge.

37. The grinding wheel of claim 36, wherein said rim extends from said surface proximate said peripheral edge.

38. The grinding wheel of claim 37, wherein said rim includes parallel concentric circular walls that are spanned by said rim surface and wherein an outermost one of said rim walls is concentric with and of the same diameter as said peripheral edge.

39. The grinding wheel of claim 31, wherein said array of abrasive pieces are uniformly spaced about said rim surface.

40. The grinding wheel of claim 31, wherein said array of abrasive pieces are uniformly spaced about said rim surface so as to cover no less than sixty percent of said rim surface or no more than eighty percent of said rim surface.

41. The grinding wheel of claim 31, wherein each said abrasive piece is disk-like with a circular peripheral edge.

42. The grinding wheel of claim 41, wherein each said abrasive piece is one-sixteenth of an inch in thickness and one inch in diameter.

43. The grinding wheel of claim 41, wherein each said abrasive piece is between one-sixteenth and one-half inch in thickness and between one-half to one and one-half inches in diameter.

44. The grinding wheel of claim 43, wherein each abrasive piece is fabricated as a superabrasive.

45. The grinding wheel of claim 44, wherein said superabrasive is cubic boron nitride.

* * * * *